US008424141B2

(12) United States Patent
Yoo et al.

(10) Patent No.: US 8,424,141 B2
(45) Date of Patent: Apr. 23, 2013

(54) CLOTH TREATING APPARATUS AND CONTROLLING METHOD THEREOF

(75) Inventors: Hea Kyung Yoo, Seoul (KR); Sog Kie Hong, Seoul (KR); Dong Won Kim, Seoul (KR); Jong Seok Kim, Seoul (KR); Dae Yun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 498 days.

(21) Appl. No.: 12/385,161

(22) Filed: Mar. 31, 2009

(65) Prior Publication Data

US 2009/0241367 A1 Oct. 1, 2009

(30) Foreign Application Priority Data

Apr. 1, 2008 (KR) ..... 10-2008-0030336

(51) Int. Cl.
*D06F 35/00* (2006.01)
*D06F 58/10* (2006.01)
*D06B 19/00* (2006.01)

(52) U.S. Cl.
USPC ..... 8/149.3; 34/389; 34/517

(58) Field of Classification Search ..... 8/149.1–149.3, 8/158, 159; 34/380, 389, 517
See application file for complete search history.

(56) References Cited

U.S. PATENT DOCUMENTS

| | | | | |
|---|---|---|---|---|
| 2005/0034248 | A1 * | 2/2005 | Oh et al. | 8/149.3 |
| 2005/0034250 | A1 * | 2/2005 | Oh et al. | 8/159 |
| 2008/0040871 | A1 * | 2/2008 | Wong et al. | 8/158 |

FOREIGN PATENT DOCUMENTS

| | | | |
|---|---|---|---|
| EP | 1 529 875 | | 5/2005 |
| EP | 1 657 345 | | 5/2006 |
| JP | 2005-193003 | A | 7/2005 |
| WO | WO 2006/098571 | | 9/2006 |
| WO | WO 2006/101312 | | 9/2006 |
| WO | WO 2007/081069 | A1 | 7/2007 |

* cited by examiner

*Primary Examiner* — Joseph L Perrin
(74) *Attorney, Agent, or Firm* — McKenna Long & Aldridge LLP

(57) ABSTRACT

The present disclosure generally relates to cloth treating machines and methods for operating a cloth treating machine. The controls can supply an appropriate amount of water initially and subsequently based on one or more selected courses or modes of operating the cloth treating machine. For example, the cloth treating machine can supply an appropriate amount of water to a steam generator initially based on a selected course. The steam generator can use the water to generate steam to sanitize and de-wrinkle clothes placed inside a cabinet of the cloth treating machine. During operation, a sensor can sense the level of the water inside the steam generator. An appropriate amount of water can then be re-supplied subsequently based on the selected course or sensed water level, repeatedly. The operation of the cloth treating machine can improve efficiency by reducing the time taken to supply water and generate steam.

6 Claims, 6 Drawing Sheets

CLOTH TREATING APPARATUS AND CONTROLLING METHOD THEREOF

CROSS REFERENCE TO RELATED APPLICATION

This application claims the benefit of Korean Patent Application No. 10-2008-0030336, filed on Apr. 1, 2008, which is hereby incorporated by reference as if fully set forth herein.

BACKGROUND OF THE DISCLOSURE

1. Field of the Disclosure

The present disclosure generally relates to a cloth treating apparatus. More specifically, the present disclosure relates to methods and apparatus to control a cloth treating apparatus, which generates steam to sanitize and/or de-wrinkle clothes.

2. Discussion of the Related Art

Generally described, cloth treating apparatus, such as washing machines, dryers, and laundry machines in general typically have washing and drying functions. More recently, a cloth treating apparatus, such as a cabinet within which to neatly place clothes, has been developed, which uses steam to sanitize and/or de-wrinkle clothes. Such a cabinet may be referred to as a "refresher."

Unfortunately, determining an appropriate amount of water to supply to such a cloth treating apparatus, for the purpose of generating steam, can be difficult. Inappropriate amounts of water often lead to poor performance and efficiency. For example, when too much water is supplied, time may be wasted in both supplying the water and generating steam. In contrast, when too little water is supplied, time is wasted re-supplying water and re-generating steam, because of the inadequacy of the initial amount of steam produced for the cloth treating apparatus.

SUMMARY OF THE DISCLOSURE

The present disclosure generally relates to a cloth treating apparatus, such as a cloth or laundry treating machine (generally referred to herein as a cloth treating machine), and methods of control and operation of the cloth treating machine that improve efficiency. In some embodiments, the cloth treating machine can include controls to supply an appropriate amount of water according to an initial pattern and/or a subsequent pattern. The patterns may be based on one or more selected courses of operation.

Advantages and features of the disclosure in part may become apparent in the description that follows and in part may become apparent to those having ordinary skill in the art upon examination of the following or may be learned from practice of the disclosure. The advantages and features of embodiments of the present disclosure may be realized and attained by the structures and processes described in the written description, the claims, and in the appended drawings.

To achieve these advantages and in accordance with the purpose of the present disclosure, as embodied and broadly described herein, a control method of a cloth treating machine comprising a steam generator configured to generate steam is provided. The control method may include a course selecting step selecting one of at least two courses, the courses having at least one of initial and subsequent water supply pattern; a initial water supply step supplying water to the steam generator according to the initial pattern of the selected course; a water level sensing step, to sense a water level in the steam generator during operation of the steam generator; and an subsequent water supply step supplying water according to a subsequent pattern of the selected course and the sensed water level.

In some embodiments, the at least two courses includes a first course and a second course having different steam supply lengths of time, respectively. The initial water supply step may sense the water level inside the steam generator and may supply water according to the sensed water level, if the first course is selected. The control method may further include a water supply stopping step stopping the water supply if the water level inside the steam generator reaches a maximum value in the initial water supply.

The initial water supply may sense a water supply time and may supply water to the steam generator according to the sensed water supply time, if the second course is selected. The control method may further include a water supply step supplying water to the steam generator for a predetermined length of time if the initial water supply is performed.

The subsequent water supply step may be performed if the first course is selected and the subsequent water supply step may not be performed if the second course is selected. The subsequent water supply step includes sensing at least one of the water supply time and the water level of the steam generator and supplying water according to the result of the sensing, if the first course is selected. The subsequent water supply step may include a water supply step supplying water to the steam generator for a first predetermined time period; a water level sensing step sensing the water level of the steam generator during the operation of the steam generator; and a water re-supplying step re-supplying water for a second predetermined time period if the water level of the steam generator reaches a predetermined low value.

Exemplary embodiments of a cloth treating machine include a cabinet comprising an accommodating space receiving laundry therein; a steam generator supplying steam to the accommodating space; a water level sensing device sensing a water level of the steam generator; a user interface for a user to select one of at least two courses; and a controller 80 controlling the steam generator and controlling water supply to the steam generator are provided. The at least two courses may include a initial water supply and subsequent water supply, respectively, and at least one of the initial and subsequent water supply in the first course may be different from at least of the initial and subsequent water supply of the second course. The at least two courses may include a first course and a second course, each of the first and second courses having a different steam supply time.

The controller 80 may sense a water level of the steam generator and may supply water to the steam generator according to the sensed water level in an initial water supply, if the first course is selected. The control device may stop the water supply if the water level reaches a maximum value in the initial water supply. The controller 80 may sense the water supply time of the steam generator and may supply water according to the sensed water supply time in a subsequent water supply. The controller 80 may supply water for a predetermined time period. The controller 80 may control the subsequent water supply to be performed, if the first course is selected, and the controller 80 may control the subsequent water supply not to be performed, if the second course is selected. The controller 80 may sense at least one of the water supply time and the water level of the steam generator and it may supply water according to the result of the sensing in the subsequent water supply, if the first course is selected.

It is to be understood that both the foregoing general description and the following detailed description are exemplary and explanatory and should not be construed as limiting the scope of the claims.

BRIEF DESCRIPTION OF THE DRAWINGS

The accompanying drawings are included to provide a further understanding of the disclosure, and are incorporated herein and constitute a part of this application. The drawings together with the description serve to explain exemplary embodiments of the present disclosure. In the drawings.

DESCRIPTION OF THE EMBODIMENTS

The present disclosure generally relates to cloth treating machines, such as a clothing refresher, which use steam to refresh, sanitize, and/or remove wrinkles from clothes, and methods of controlling such machines. Embodiments of the present disclosure can also be applicable to other types of cloth treating machines, such as washing machines and dryers, and broadly any laundry machine that includes washing and drying functions.

Reference will now be made in detail to the specific embodiments of the present disclosure, examples of which are illustrated in the accompanying drawings. Wherever possible, the same reference numbers will be used throughout the drawings to refer to the same or like parts.

Figure 1:
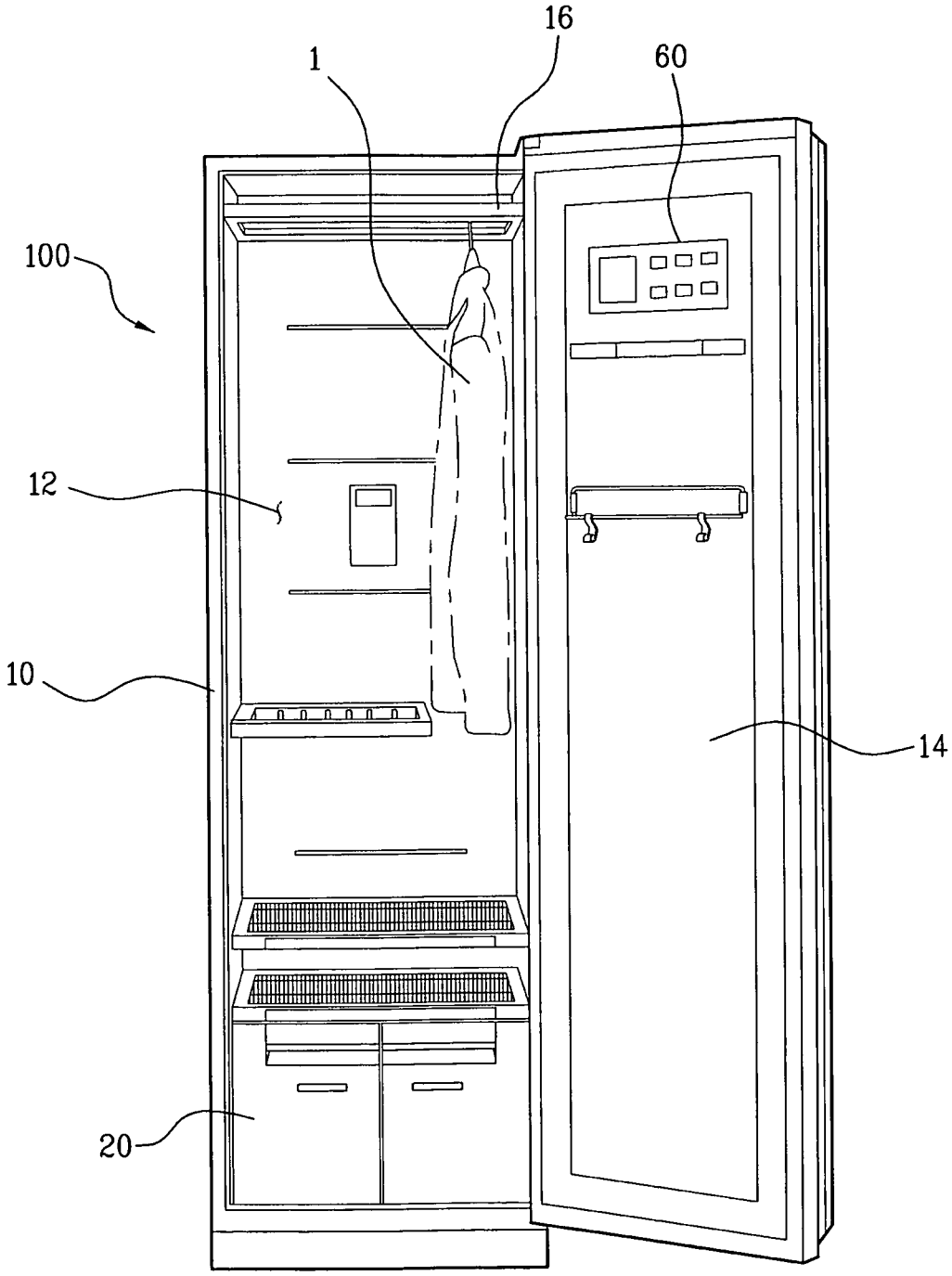
FIG. 1 illustrates a front view of a cloth treating machine and controls, according to an embodiment of the disclosure.

FIG. 1 illustrates a front view of a cloth treating machine 100 according to an embodiment of the invention. Cloth treating machine 100 can include a cabinet 10, a steam generator (30, FIG. 2), a controller (80, FIG. 2), and a user interface 60. The cabinet 10 can define an accommodating space 12 for receiving laundry therein. The steam generator 30 can spray steam into the accommodating space 12 selectively, for example. The controller 80 can be used to control the steam generator 30.

In the cabinet 10, various elements can be provided in the accommodating space 12. The accommodating space 12 can be accessed by a door 14, which opens and closes. Various kinds of supporters 16 can be provided in the accommodating space 12 for holding laundry 1. Laundry 1 can be neatly hung on or laid upon the supporters 16

A mechanism compartment 20 may be formed in the cabinet 10. The steam generator 30, which selectively supplies steam to the accommodating space 12, can be mounted in the mechanism compartment 20. In the exemplary embodiment of FIG. 1, the mechanism compartment 20 is provided underneath the accommodating space 12. Forced air can then be supplied upward from components in the mechanism compartment 20. It is preferable to position the mechanism compartment 20 below the accommodating space 12, because the dried air supplied by the components within the mechanism compartment 20 is generally a high temperature and therefore has the natural tendency to ascend.

Figure 2:
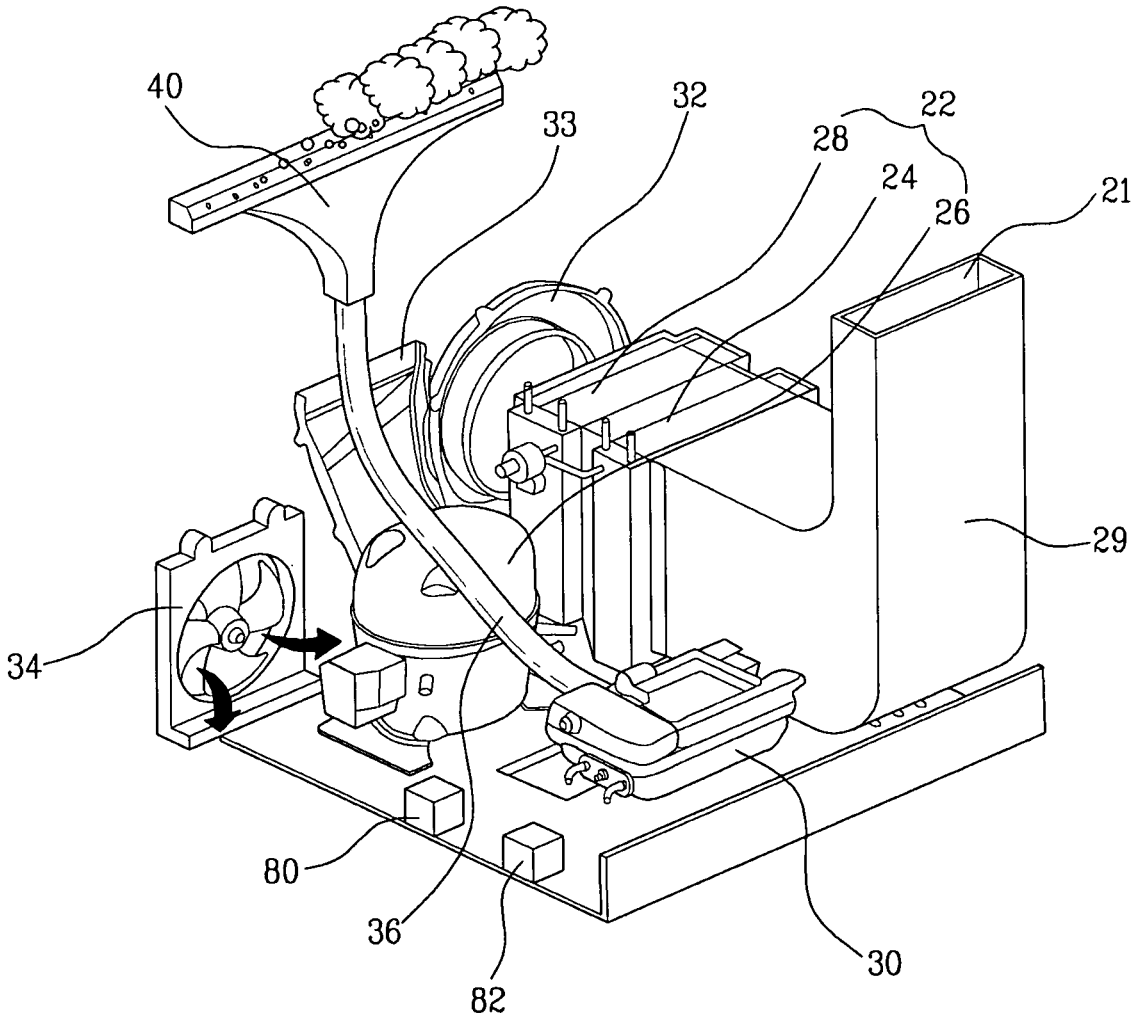
FIG. 2 illustrates a perspective view of an inner structure of the mechanism compartment of FIG. 1, according to an embodiment of the disclosure.

FIG. 2 illustrates a perspective view of components of the cloth treating machine 100 that may be installed in the mechanism compartment 20. A first component, the steam generator 30 may be used to generate steam supplied to the accommodating space 12. Steam advantageously sanitizes and de-wrinkles laundry 1 in the accommodating space 12 due to its temperature and moisture content. The laundry 1 may also become refreshed because of fabric bulk.

The timing of steam sprayed by the steam generator 30 may be adjusted or changed based on the load in the accommodating space 12. A controller 80 can execute commands stored in a memory 82, which cause predefined amounts of water to be converted into steam according to predefined patterns/timings of water supply. Additionally, the controller 80 can execute commands stored in a memory 82, which cause the steam can be sprayed before or after hot air is supplied by the hot air supply device 22.

The steam generated by steam generator 30 can be supplied to the accommodating space 12 via a steam hose 36 and a steam nozzle 40. In one embodiment, the steam nozzle 40 may be positioned at the top of the mechanism compartment 20 (i.e., at the bottom of the accommodating space 12) to supply steam. The steam hose 36 can be selected to have a shorter or longer length depending on the temperature or amount of condensation of steam desired. For example, when the length of steam hose 36 is shorter the temperature of the steam may be prevented from decreasing and the amount of steam condensed onto the inner surfaces of the steam hose 36 may be less than if the hose 36 was longer.

Mechanism compartment 20 may further include the hot air supply device 22 to selectively supply hot air to the accommodating space 12. The hot air supply device 22 can heat air and supply heated and/or dehumidified air to the accommodating space 12, to dry the laundry within the accommodating space 12. Hot air supply device 22 may be an electric or gaseous type heater or a heat pump. A heat pump may advantageously act to dehumidify and heat air.

In the exemplary embodiment of FIG. 2, hot air supply device 22 is a heat pump. Heat pump 22 may be substantially similar to a heat pump used in air conditioners. Heat pump 22 can include an evaporator 24, a compressor 26, a condenser 28, and an expansion valve (not shown), through which refrigerant can be circulated sequentially to dehumidify and heat air. Evaporator 24 can evaporate refrigerant and absorb latent heat of ambient air, such that the air can be cooled to condense moisture contained in the air. When the refrigerant has passed through the compressor 26 it can be condensed in the condenser 28. During condensation, the latent heat can be heat-exchanged with ambient air and thus, the ambient air may be heated. Both evaporator 24 and condenser 28 can have a heat-exchanging function. Air passing through the evaporator 24 and condenser 28 from the accommodating space 12, and/or other areas, can be dehumidified and heated for re-supply to the accommodating space 12.

An inlet 21 may be formed at the top of the mechanism compartment 20 to draw air from inside the accommodating space 12 into a circulation duct 29. The circulation duct 29 may guide air drawn in from the accommodating space 12 to the evaporator 24, the condenser 28, and a fan 32. The air drawn into the inlet 21 may be dehumidified and heated when passed through the hot air supply device 22, and then re-supplied to the accommodating space 12 by a fan 32, which pumps the air through an outlet 38.

A filter (not shown) may also be provided at the inlet 21. The filter may filter various foreign substances that can be in the air supplied to the circulation duct 29.

A circulation fan 34 may be provided in a rear portion of the mechanism compartment 20. The circulation fan 34 can draw in external air from outside the mechanism compartment 20 to the space inside the mechanism compartment 20. Circulation of air within the space inside the mechanism compartment 20 may serve to cool the hot air supply device 22. In an embodiment where the hot air supply device 22 is a heat pump, the compressor 26 of the heat pump 22 can be cooled by the air drawn into the mechanism compartment 20 by circulation fan 34. The cooling effect provided by circulation fan 34 serves to prevent the temperature inside the mechanism compartment 20 from rising to undesirable levels.

Figure 3:
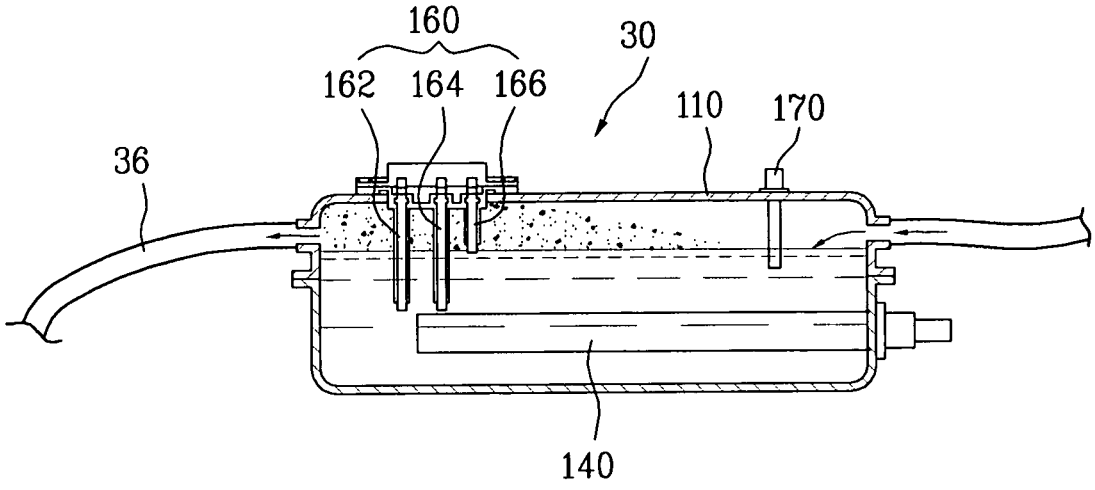
FIG. 3 illustrates a sectional view of an inner structure of the steam generator of FIG. 2, according to an embodiment of the disclosure.

FIG. 3 illustrates a sectional view of an inner structure of the steam generator 30. Steam generator 30 can include a water tank 110, heater 140, water level sensor 160, and a temperature sensor 170. Water can be supplied to the water tank 110 and the heater 140 can be mounted in the water tank 110. Water level sensor 160 can measure a water level inside the steam generator 30. Temperature sensor 170 can measure a temperature inside the steam generator 30. Signals indicative of temperature and water level may be provided to the controller 80 (FIG. 2).

When the water inside the steam generator 30 is heated by the heater 140, steam can be generated and supplied to the accommodating space 12. A water supply source supplying water to the steam generator 30 may be an external water tap or a container holding an amount of water, and positioned, for example, in the mechanism compartment 20. The water supply source may be operationally connected to the cloth treating machine 100 in such a way as to allow its disconnection and separation therefrom. For example, the user may disconnect the water supply source (container) from the mechanism compartment 20 to fill up container with water. After container is filled with water, the user can re-connect the water supply source back to the cloth treating machine 100 in the mechanism compartment 20.

Water level sensor 160 can include a common electrode 162, a low level electrode 164 and a high level electrode 166. In an embodiment, water level sensor can sense whether electric currents an electric current is passing between the common electrode 162 and the high level electrode 166 and/or between the common electrode 162 and the low level electrode 164 to determine whether the water level is high or low. After sensing the water level inside the steam generator 30, the water level sensor can transmit a signal having the sensed information to the controller 80. Controller 80 can then control the water supply (e.g., by operating electromechanical valves) based on the sensed signal and/or the lengths of time since the beginning of the course.

Figure 4:
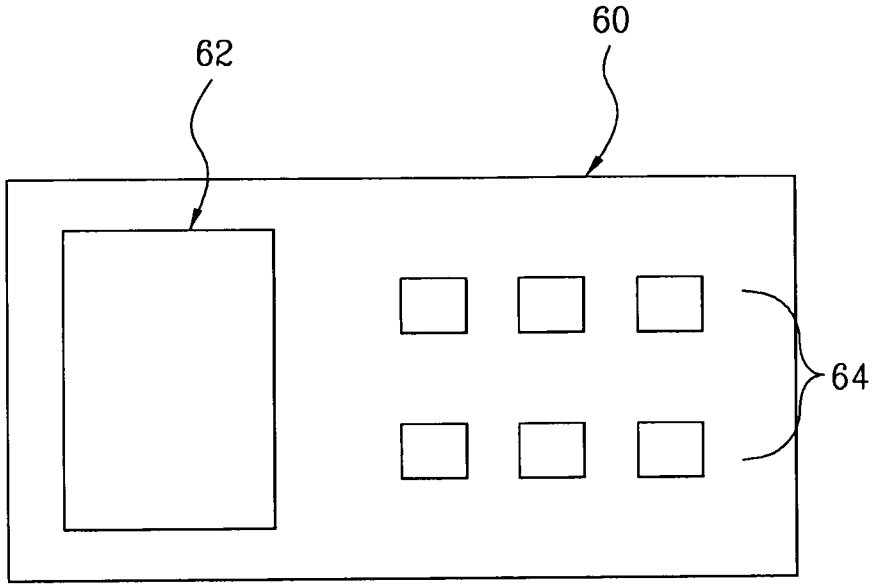
FIG. 4 illustrates a user interface provided at a predetermined portion of a cabinet of FIG. 1, according to an embodiment of the disclosure.

FIG. 4 illustrates a user interface 60, according to one embodiment of the invention. In one embodiment, the user interface 60 may be provided on a predetermined portion of the inside or outside of the cabinet 10. In an embodiment, the user interface 60 may be provided on an internal or external surface of the door 14. User interface 60 may allow the user to select one of at least two courses (alternatively referred to as a cycle or mode) of treating laundry. User interface 60 may include a course selecting part 64 for selecting a course and a displaying part 62 for displaying information about a selected course. In some embodiments, the course selecting part 64 may be provided in various forms, such as a button-type, rotary type, touchpad type, and/or other types of interfaces.

The course selecting part 64 may allow a user to select from between at least two courses, such as a first course and a second course, capable of supplying steam to the accommodating space 12. The lengths of time for supplying steam can be different in the first and second courses. In addition, the pattern of water supply to the steam generator to generate steam during the first and second courses may be different from each other and may be preset. The water supply patterns can include an initial water supply pattern and/or a subsequent water supply pattern. For example, the first and second courses may be preset to have different initial water supplying patterns, different subsequent water supply patterns, or both different initial and subsequent water supply patterns.

The water supply pattern of the first course can be different from that of the second course because steam supplying time can vary based on the selected course. For example, the first course can be preset to accommodate a larger load of laundry than the second course. In such an exemplary embodiment, the steam supplying time of the first course can be preset to between approximately 8 to 10 minutes or more, and the steam supplying time of the second course can be preset to between approximately 4 to 8 minutes. Of note, the steam supplying time periods provided are exemplary and other time values can be used.

By way of example, when steam is supplied to the accommodating space 12 according to either the first or the second courses, water may be initially supplied to the steam generator 30 according to a predefined initial water supply pattern, and heated to generate steam. The initial amount of water supplied to the steam generator 30 may be an important factor in determining the performance of the selected course of the cloth treating machine 100. For example, if the initial pattern of water supply supplies a substantially large amount of water when the load of laundry 1 may be relatively small, too much time may be taken to heat the water and supply steam to the laundry 1 in the accommodating space 12. On the other hand, if the initial pattern of water supply supplies a substantially small amount of water when the load of laundry 1 in the accommodating space 12 is relatively large, additional water may be needed to be re-supply the steam generator after its first steam generation cycle, in order to achieve satisfactory performance of the cloth treating apparatus.

When the initial amount of water supplied is insufficient for the load of laundry 1 in the accommodating space 12, according to any selected course, the controller can determine whether water should be re-supplied to the steam generator in the middle of the steam generating operation. It is preferable to re-supply the water in small amounts for subsequent steam operations. The water may be re-supplied at frequent intervals and in small amounts. Advantageously, this can prevent a large amount of water being supplied during any subsequent water supplying step. Supplying a large amount of water in a subsequent water supply step can result in a substantially larger amount of time being wasted to re-supply the water and to generate steam.

Figure 5:
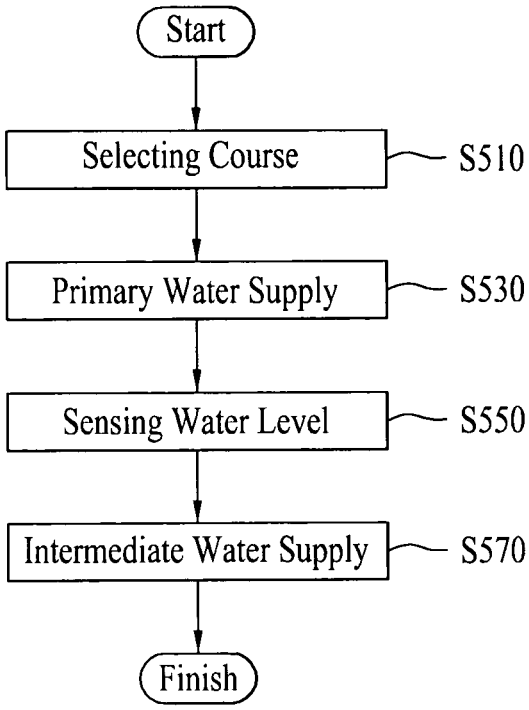
FIG. 5 illustrates a flow chart of an exemplary method of controlling a cloth treating machine, according to an embodiment of the disclosure.

FIG. 5 illustrates a flow chart of an exemplary method of controlling a cloth treating machine 100. The method can include a course selecting step (S510), a initial water supply step (S530), a water level sensing step (S550), and an subsequent water supply step (S570).

In the course selecting step (S510), the user can select a course or mode of operating the cloth treating machine 100. During the initial water supply step (S530), an initial water supply can be performed according to a first pattern, based on the selected course. In the water level sensing step (S550), a water level inside the steam generator 30 can be sensed during operation of the steam generator 30. Signals indicative of the water level may be communicated to the controller 80. In the subsequent water supply step (S570), a subsequent water supply can be performed according to a subsequent pattern, based on the selected course.

Beginning in block S510, the user may load laundry 1 into the cloth treating machine 100 and select a course. The user can use the user interface 60 of the cloth treating machine (S510) to select the course. Cloth treating machine 100 may include at least two courses that can supply steam to the laundry 1 in the accommodating space 12, such as first and second courses.

The first and second courses may be preset to have different lengths of time for supplying steam. For example, when water is supplied to generate steam at least one of the initial and subsequent water supplying patterns may be preset differently. The first and second courses may be preset to have different initial water supplying patterns, different subsequent water supplying patterns, or different initial and subsequent water supplying patterns from each other.

In the illustrated embodiments, both the initial and subsequent water supplying patterns in the first course may be different from the second course. The water supplying pattern of the first course can be different from the second course because the lengths of time of supplying steam can be based on the selected course. For example, the amount or load of laundry may be substantially larger in the first course than the second course.

The steam supply time may be preset to between approximately 8 to 10 minutes or more in the first course and between approximately 4 to 8 minutes in the second course, for example. Of note, these time values are exemplary and other values can be used. After a course is selected, the corresponding initial and subsequent water supply patterns can be determined.

Moving to block S530, after a course is selected water can be supplied to the steam generator 30 depending on the selected course. A controller 80 can be used to sense the water level inside the steam generator 30 and start the water supply. Because the load of laundry 1 corresponding to the first course can be relatively larger than the second course, the steam supplying time of the first course may be substantially longer than that of the second course. Accordingly, the controller 80 may also supply water to the steam generator 30 for a longer period of time and a larger amount of water. For example, water can be supplied until the highest level is sensed inside the steam generator 30 by water level sensor 160. When this occurs, the maximum amount of water may be supplied to the steam generator 30 and the time and/or amount of steam supplying may be increased.

In some embodiments, after the controller 80 supplies water to the steam generator 30 initially, the water can be supplied based on a water supply time. When the load of laundry 1 corresponding to the second course is relatively smaller than the first course and the steam supply time of the second course is substantially shorter than that of the first course, the water supply time can be used. Thus, during the initial water supplying of the second course the maximum amount of water may not be supplied to the steam generator 30. Of note, it may advantageous not to supply an appropriate amount of water to the steam generator 30 during the first course. When the second course is selected, the water supply time can then be adjusted appropriately during the initial water supply to not use the water level to control the water supply.

The time of performing the initial water supply can be adjustable based on the capacity of the steam generator 30, the capacity of accommodating space 12, the amount or load of laundry 1, and/or preset according to the course. Thus, the water supply time may not be limited to specific values. In some embodiments, the initial water supply time may be preset between approximately 10 to 20 seconds, for example. As a result, when the second course is selected, the controller 80 can perform the initial water supply for approximately 10 to 20 seconds.

Moving to block S550, after the initial water supply occurs, the controller 80 can drive the steam generator 30 and sense the water level inside the steam generator 30 continuously and/or intermittently. The sensing can occur simultaneously with the supplying steam to the accommodating space 12.

In an embodiment, the water level inside the steam generator 30 may be lowered to a level (which may be predetermined) that corresponds to a low level sensed by the water level sensor 160. This can occur before the steam supply time, which can be preset based on a selected course. Continuing to block S570, the controller 80 can then determine whether the subsequent water supply can start according to the selected course and perform the subsequent water supply based on the result of determination.

In exemplary embodiments, when the first course is selected in the course selecting step, the controller 80 can perform the subsequent water supply. When the second course is selected in the course selecting step, the controller 80 may not perform the subsequent water supply. For example, if the first course is selected in the course selecting step, the controller 80 can perform the subsequent water supply. As described above, the steam supplying time of the first course can be preset for substantially longer than that of the second course. Thus, if the water inside the steam generator 30 reaches a low value, water may need to be re-supplied in the first course.

The steam supply time of the second course can be preset shorter than that of the first course. When the initial water supply is performed appropriately, the subsequent water supply may not need to be performed. Thus, the subsequent water supply may be performed when only the first course is selected, in some embodiments.

When the first course is selected and the subsequent water supply is performed, the controller 80 can sense at least one of the water level and the water supply time of the steam generator 30 to determine when to start the water supply. In addition, both the water level and the water supply time may be sensed and the water supplying can be performed based on the result of sensing the water level and/or water supply time.

For example, when the subsequent water supply is performed based on the selected first course, the maximum amount of water may not have to be supplied to the steam generator 30 as may occur during the initial water supply. This can occur because the controller 80 can sense the water level and/or the water supply time and supply water based on the sensing. Of note, the sensing may not occur during the initial water supplying.

Figure 6:
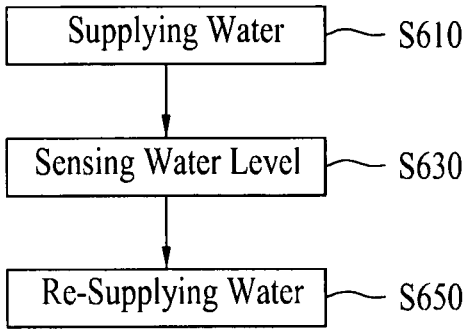
FIG. 6 illustrates a flow chart of an exemplary method of controlling the subsequent water supply of FIG. 5, according to an embodiment of the disclosure.

FIG. 6 illustrates a flow chart of an exemplary method of controlling the subsequent water supply. The method can include supplying water to the steam generator 30 for a predetermined time period (S610), sensing the water level during the operation of the steam generator 30 (S630) and re-supplying water to the steam generator 30 for a predetermined time period when a water level inside the steam generator 30 may be at a low value or below (S650).

In block S610, water can be supplied to the steam generator 30 for a predetermined length of time by a controller 80 of the cloth treating machine 100. The predetermined length of time may be adjusted and generated based on the amount or load of laundry 1, the volume of the accommodating space 12, and/or the capacity of the steam generator 30. The predetermined length of time can also be preset based on each course and thus the predetermined length of time may not be limited to specific values. In exemplary embodiments, the predetermined length of time can be preset between 3 to 5 seconds. Of note, the predetermined time period can be controlled so that water is not constantly re-supplied to the steam generator 30 (as may occur when it is too short) and/or the water takes too long to heat and steam (as may occur when it is too long).

Moving to block S630, after supplying water for the predetermined length of time, the controller 80 can drive the steam generator 30 and sense the water level inside the steam generator 30 continuously or intermittently during operation. When steam is supplied by the steam generator 30, the water level can decrease to reach a low value again.

Continuing to block S650, the controller 80 may then re-perform the water supplying. This can occur when the steam supplying time is shorter than the time period preset corresponding to the first course (S650). When this occurs, the water re-supplying (S650) may be performed for the same length of time as the water supplying (S610).

The above-referenced steps of supplying water subsequently can be repeated until the steam supply time reaches the predetermined steam supply time of the first course. When the steam supply time reaches the predetermined steam supply time of the first course, the re-supply of water may no longer be performed and steam generator 30 can stop operation.

When steam may be supplied in the steps described above, the controller 80 can also control the hot air supply device 22, which supplies dry hot air to the laundry 1 in the accommodating space 12. The dry hot air can dry laundry 1 so it is in a suitable or optimal state to be worn. After the hot air is supplied, the selected course can finish.

The cloth treating machine 100 can supply an appropriate amount of water initially based on a select course or mode of operation. When water is supplied, steam can be supplied for a substantially short time period. In addition, an appropriate amount of water can be supplied subsequently based on the selected course or mode of operation. This can allow the time taken for the subsequent water supplying and/or re-supplying steam to be reduced.

It will be apparent to those skilled in the art that various modifications and variations can be made in the present disclosure without departing from the spirit or scope of the disclosure. Thus, it is intended that the present disclosure cover any modifications and variations within the scope of the appended claims and their equivalents.

What is claimed is:

1. A control method of a cloth treating machine comprising a steam generator generating steam, the control method comprising:

receiving, at a controller, a signal indicative of a selection of one of at least two courses supplying steam to laundry, the at least two courses each having different initial and subsequent water supply patterns;

supplying, according to a signal from the controller, water to the steam generator according to an initial water supply pattern based on the selected course;

sensing, at the controller based on received signals, a water level during an operation of the steam generator; and supplying, according to a signal from the controller, water to the steam generator according to a subsequent water supply pattern based on the selected course, wherein the at least two courses comprise a first course and a second course having different steam supply time periods to laundry, respectively, wherein the amount or load of laundry is preset larger in the first course than in the second, wherein the initial water supply step senses the water level inside the steam generator and supplies water according to the sensed water level, if the first course is selected, and wherein the initial water supply step supplies water based on a water supply time, if the second course is selected.

2. The control method of claim 1, further comprising:

stopping the supply of water if the sensed water level inside the steam generator reaches a maximum value during the supplying of water to the steam generator according to the initial water supply pattern.

3. The control method of claim 1, further comprising:

supplying water to the steam generator for a predetermined length of time after the initial water supply is performed.

4. The control method of claim 1, wherein the subsequent water supply step is performed if the first course is selected, and the subsequent water supply step is not performed if the second course is selected.

5. The control method of claim 4, wherein the subsequent water supply step comprises:

determining at least one of the water supply time of the initial water supply step and the water level of the water in the steam generator; and supplying water according to the result of the determining, if the first course is selected.

6. The control method of claim 5, wherein the subsequent water supply step comprises:

a water supply step supplying water to the steam generator for a first predetermined length of time;

sensing the water level of the steam generator during the operation of the steam generator; and re-supplying water for a second predetermined time period if the water level of the steam generator is at or below a low value.

* * * * *